United States Patent [19]

Potucek et al.

[11] 4,014,488

[45] Mar. 29, 1977

[54] FASTENER FEED APPARATUS AND METHOD

[75] Inventors: Frank R. Potucek, Des Plaines; Allen R. Obergfell, Park Ridge, both of Ill.

[73] Assignee: Duo-Fast Corporation, Franklin Park, Ill.

[22] Filed: July 10, 1975

[21] Appl. No.: 594,761

Related U.S. Application Data

[62] Division of Ser. No. 412,684, Nov. 5, 1973, Pat. No. 3,930,297.

[52] U.S. Cl. ..... 226/6; 226/8; 226/53; 226/55; 226/62; 226/147; 227/136

[51] Int. Cl.[2] ..... B65H 17/40

[58] Field of Search ..... 226/6, 8, 53, 55, 57, 226/58, 62, 147, 151; 227/136, 95; 29/429, 431

[56] References Cited

UNITED STATES PATENTS

| | | | |
|---|---|---|---|
| 1,415,477 | 5/1922 | Puc | 226/55 X |
| 1,436,020 | 11/1922 | Dobyne | 226/151 |
| 2,336,662 | 12/1943 | Wintriss | 226/55 X |
| 3,041,619 | 7/1962 | Batcheller | 226/151 X |

*Primary Examiner*—Richard A. Schacher
*Attorney, Agent, or Firm*—Mason, Kolehmainen, Rathburn & Wyss

[57] ABSTRACT

A fastener feed assembly for a tool such as a power screwdriver having a drive member such as a rotatable bit includes a base fixed to the tool and a nose assembly slidably related to the base. The nose assembly includes a workpiece engaging surface, and when the tool is moved toward the workpiece during a fastener driving operation, the base moves toward the nose assembly. A return spring separates the base and nose assembly when the tool is withdrawn away from the workpiece. A strip of fasteners is fed from a magazine along a feed path through the nose assembly with sequential fasteners located in a drive position. Normally the drive member is spaced from a fastener in the drive position. During movement of the tool toward the workpiece in a driving operation, the drive member moves into engagement with a fastener in the drive position, and then continues to move in order to drive the fastener into the workpiece. A pawl is engageable with the strip in order to advance the strip along the feed path. During the driving operation, a feed mechanism operates in response to movement of the base toward the nose assembly to cock the pawl by moving it away from its home position along the strip away from the drive position. A lost motion arrangement delays cocking of the pawl until after secure engagement of the drive member with a fastener in the drive position. In response to withdrawal of the tool from the workpiece, the feed mechanism returns the pawl to its home position to feed an adjacent fastener of the strip to the drive position. Feed movement of the pawl is delayed until withdrawal of the drive member from the strip feed path. The strip includes a carrier with structure deformed during the drive operation for preventing reverse movement of the strip during cocking of the pawl.

6 Claims, 18 Drawing Figures

Fig. 2
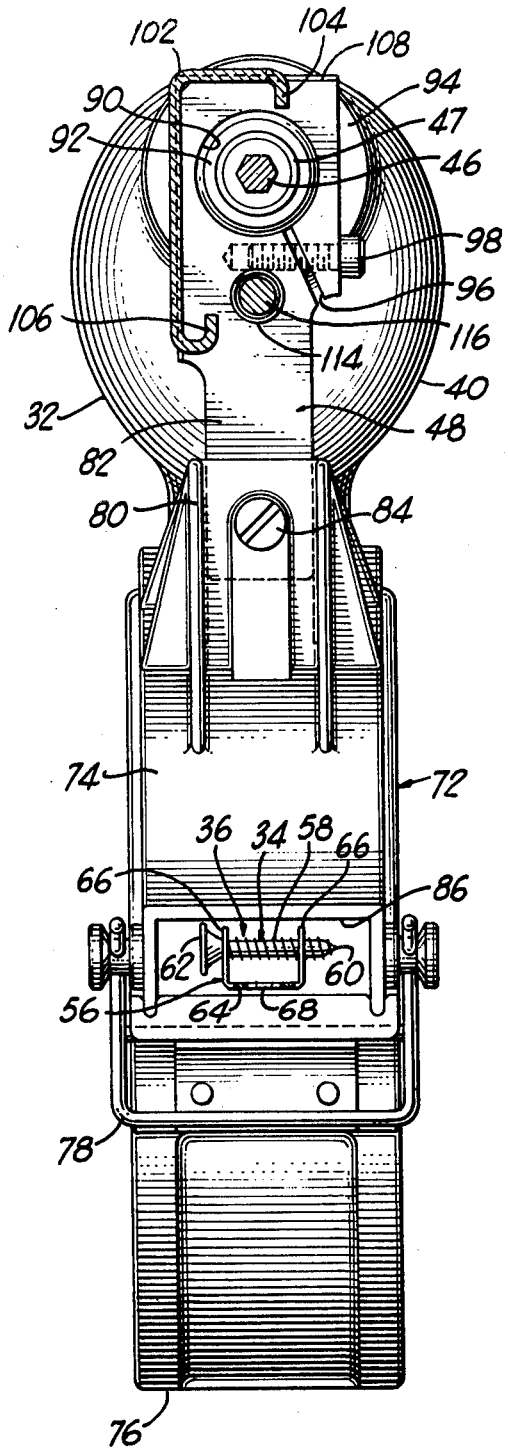
Fig. 3
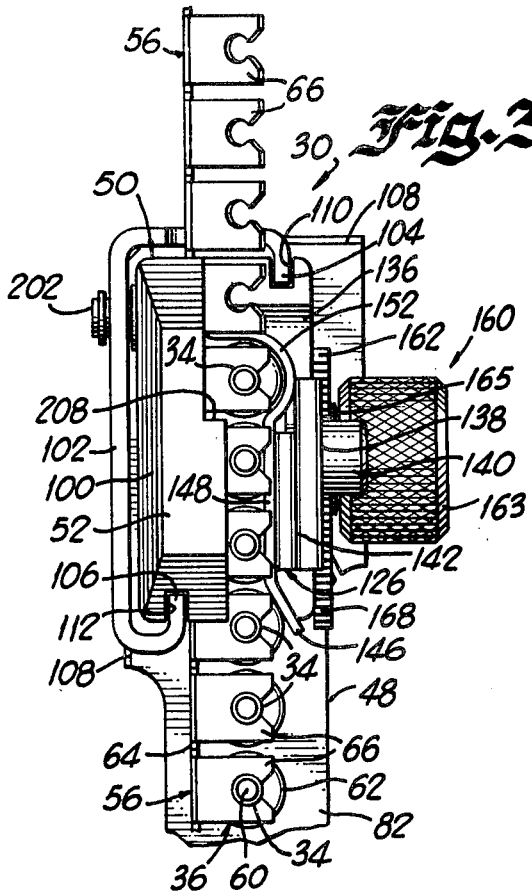
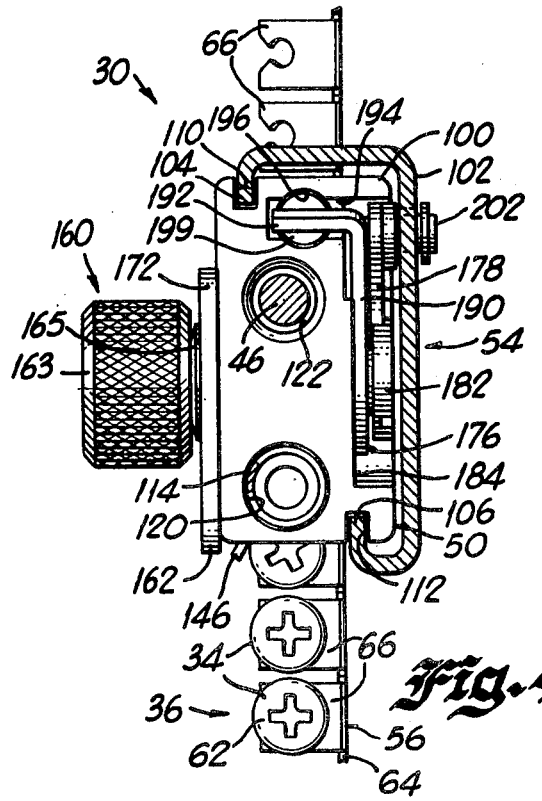
Fig. 4

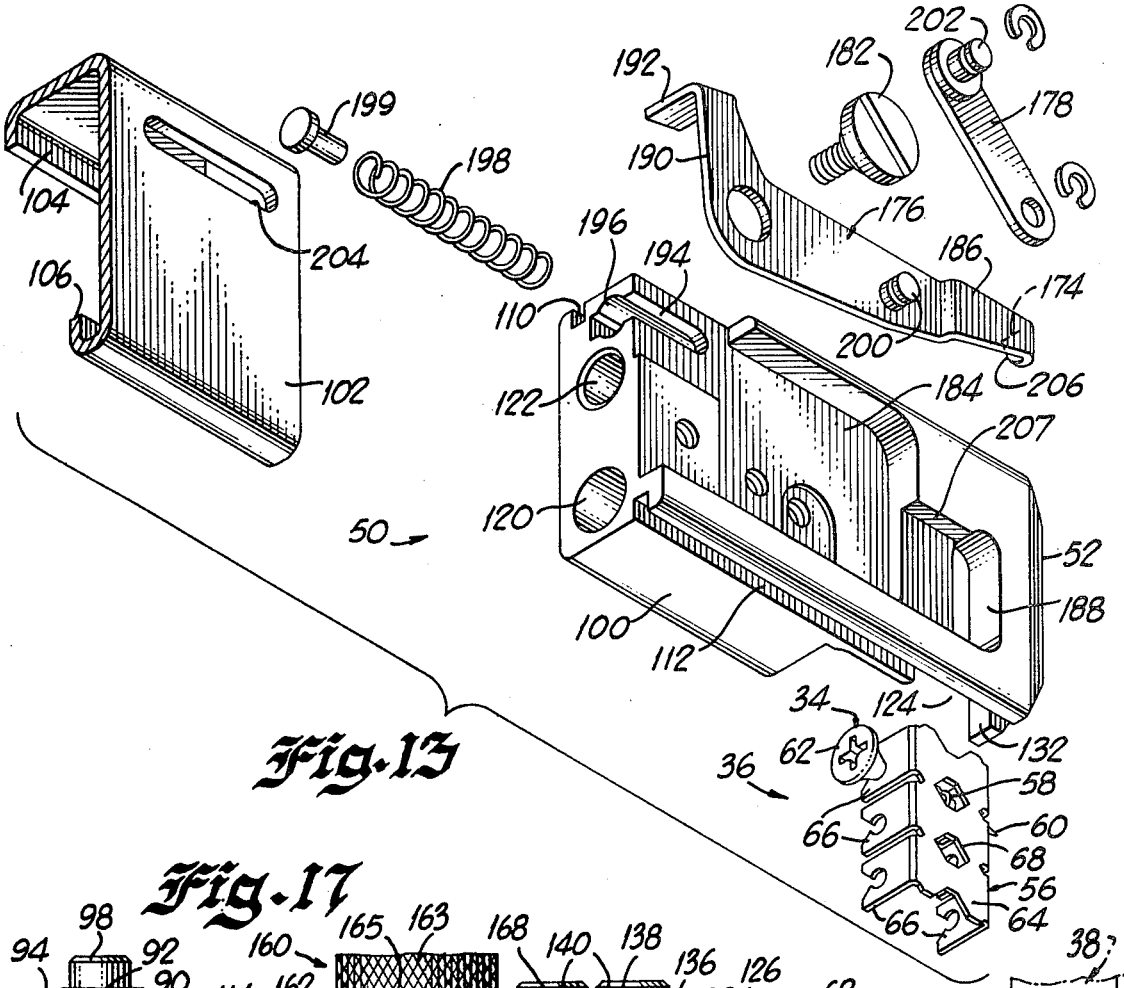
Fig. 13
Fig. 17
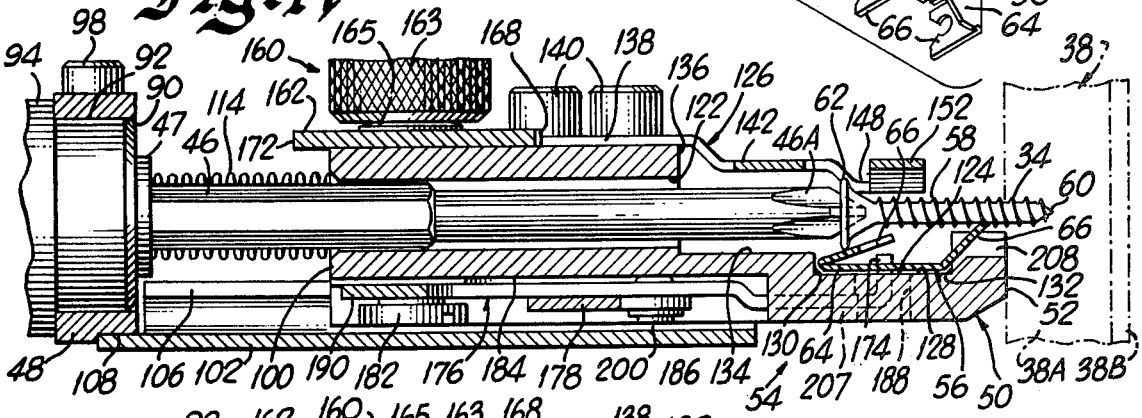
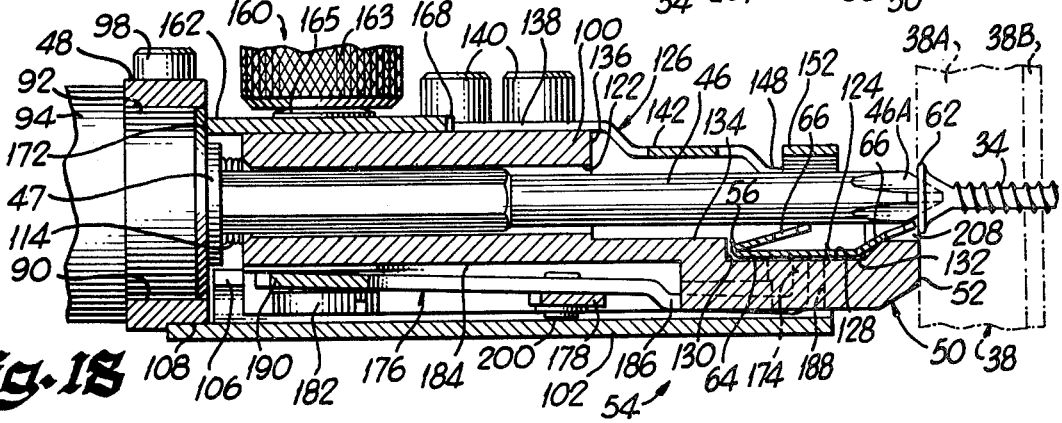
Fig. 18

Fig. 14
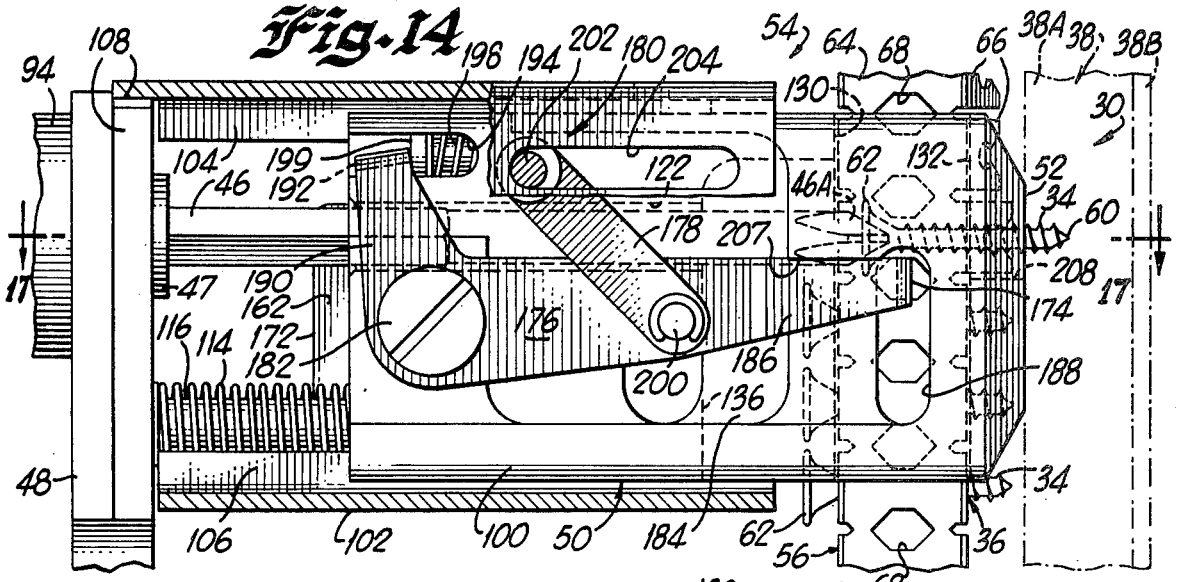
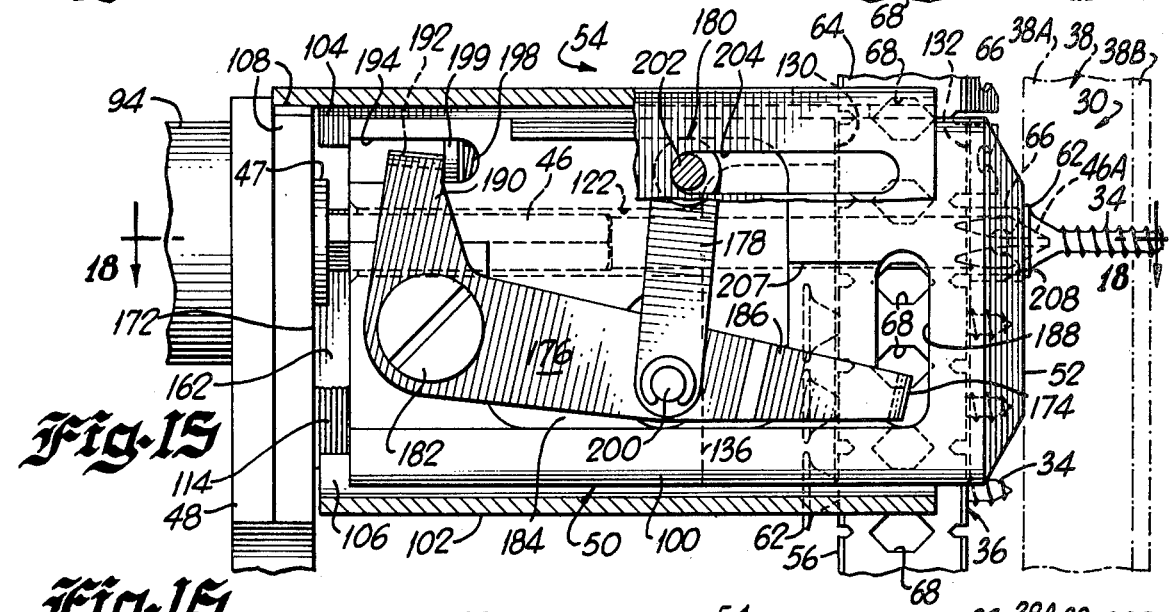
Fig. 15
Fig. 16
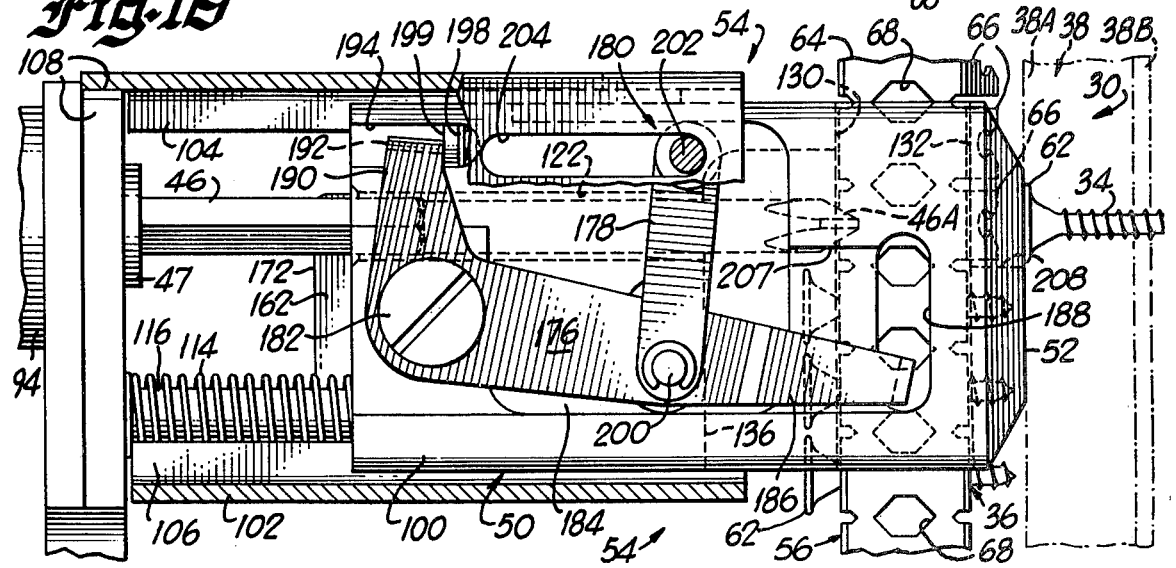

FASTENER FEED APPARATUS AND METHOD

This is a division of application Ser. No. 412,684 filed Nov. 5, 1973 now U.S. Pat. No. 3,930,297.

The present invention relates to improvements in apparatus and methods for feeding fasteners to a fastener driving tool such as a power screwdriver.

Power tools are increasingly used for driving threaded or rotary entry fasteners. As one example, in modern building construction drywall panels, metal panels, or the like are attached to metal studs or other support elements by rotary fasteners driven by power screwdrivers. Typically, a power screwdriver used for this purpose includes a housing with an integral handle and a rotary driving bit extending from the housing. In a conventional fastener driving operation, the bit is engaged with the fastener and the tool is moved toward the panel or other workpiece as the bit rotates to drive the fastener into the workpiece. Individual fasteners are manually positioned for driving, for example by placing the fastener in proximity to a magnetic driver bit or by placing the fastener against the workpiece and thereafter engaging the driver bit with the fastener. Manual handling of individual fasteners is slow, inconvenient and undesirable.

Objects of the present invention are to provide improvements in apparatus and methods for feeding fasteners to a fastener driving tool; to provide a feed assembly particularly useful for feeding fasteners to tools, such as power screwdrivers, of the type which are moved toward a workpiece in order to drive a threaded or rotary entry fastener into the workpiece; to provide a feed assembly utilizing the movement of the tool relative to the workpiece during the driving operation for actuating a fastener feed mechanism; and to provide a feed assembly wherein the feeding mechanism does not interfere with the engagement of the driver bit with a fastener in the drive position. Other objects are to provide fastener feed assemblies which are simple, inexpensive, sturdy and reliable in operation.

In brief, a fastener feed assembly constructed in accordance with the present invention may comprise a base adapted to be mounted on a tool such as a power screwdriver. A nose assembly has a work engaging surface contacting the workpiece during driving of a fastener. The nose assembly is mounted for movement relative to the base so that the base moves in one direction relative to the nose assembly when the tool is pressed toward the work during the fastener driving operation. A return spring moves the base in the opposite direction as the tool is withdrawn from the workpiece after a fastener driving operation. A fastener drive member such as a driver bit is adapted to be connected to the tool and is movable in a drive path from a normal position through the nose assembly and toward the workpiece during the fastener driving operation.

A strip of fasteners extends from a magazine to a feed path in the nose assembly with one fastener of the strip located in a drive position between the drive member and the workpiece. A pawl is engageable with the strip and is movable between a home position and a cocked position. In accordance with the invention, an actuating means is responsive to movement of the base relative to the nose assembly in the one direction for moving the pawl to the cocked position. After driving of a fastener from the drive position, the actuating means is responsive to movement of the base means relative to the nose assembly in the opposite direction for returning the pawl to its home position thereby to advance the next fastener of the strip into the drive position.

The fastener strip comprises a flexible carrier including a base flanked by parallel sets of tabs extending normal to the base and supporting fasteners in generally parallel relation. In accordance with the invention, a tab is deformed by driving of a fastener therefrom in order to move the tab into engagement with a stop defined in the nose assembly. As a result, return movement of the strip during movement of the pawl from the home position to the cocked position is prevented.

In accordance with another feature of the invention, there is provided a lost motion connection between the pawl and its actuating means so that during a fastener driving operation, movement of the pawl to the cocked position is delayed until after secure engagement of the drive member with the fastener to be driven. In addition, in some embodiments of the invention, the actuating means does not operate the pawl to advance the carrier strip until after the drive member is retracted away from the region of the carrier strip.

Another feature of the invention resides in a novel magazine and strip arrangement for feeding fasteners to the nose assembly. A magazine contains a coil of the fastener strip supported below and generally in the plane of the tool housing and handle. The portion of the strip between the magazine and the nose assembly is twisted through a substantial angle to provide a convenient and easily handled configuration, to avoid interference between the fasteners and workpiece, and to permit relative movement between the magazine and nose assembly.

Briefly, the method of the present invention may comprise supporting a fastener in a drive position aligned with the rotatable bit of a power screwdriver and pushing the screwdriver toward a workpiece in order to engage the bit with the fastener and to drive the fastener into the workpiece. In accordance with the invention, a carrier strip drive pawl is retracted along the strip from its home position to a cocked position during the pushing step. As the screwdriver is withdrawn away from the workpiece, the pawl is advanced to its home position in order to advance the carrier strip and to move an adjacent fastener into the drive position.

The invention together with the above and other objects and advantages may be best understood with reference to the following detailed description of the embodiments of the invention illustrated in the accompanying drawings, wherein:

FIG. 2 is a section view taken along the line 2—2 of FIG. 1;

FIG. 3 is a fragmentary, enlarged front elevational view taken from the line 3—3 of FIG. 1;

FIG. 4 is an enlarged sectional view taken along the line 4—4 of FIG. 1;

FIG. 13 is an exploded perspective view on an enlarged scale of parts of the assembly of FIG. 1;

FIG. 14 is a view similar to FIG. 6 illustrating the assembly at an intermediate condition during driving of a fastener;

FIG. 15 is a view similar to FIG. 6 illustrating the assembly at the completion of a fastener driving stroke;

FIG. 16 is a view similar to FIG. 6 illustrating the assembly at an intermediate point during withdrawal of the tool;

FIG. 17 is a sectional view taken along the line 17—17 of FIG. 14;

FIG. 18 is a sectional view taken along the line 18—18 of FIG. 15.

Figure 1:
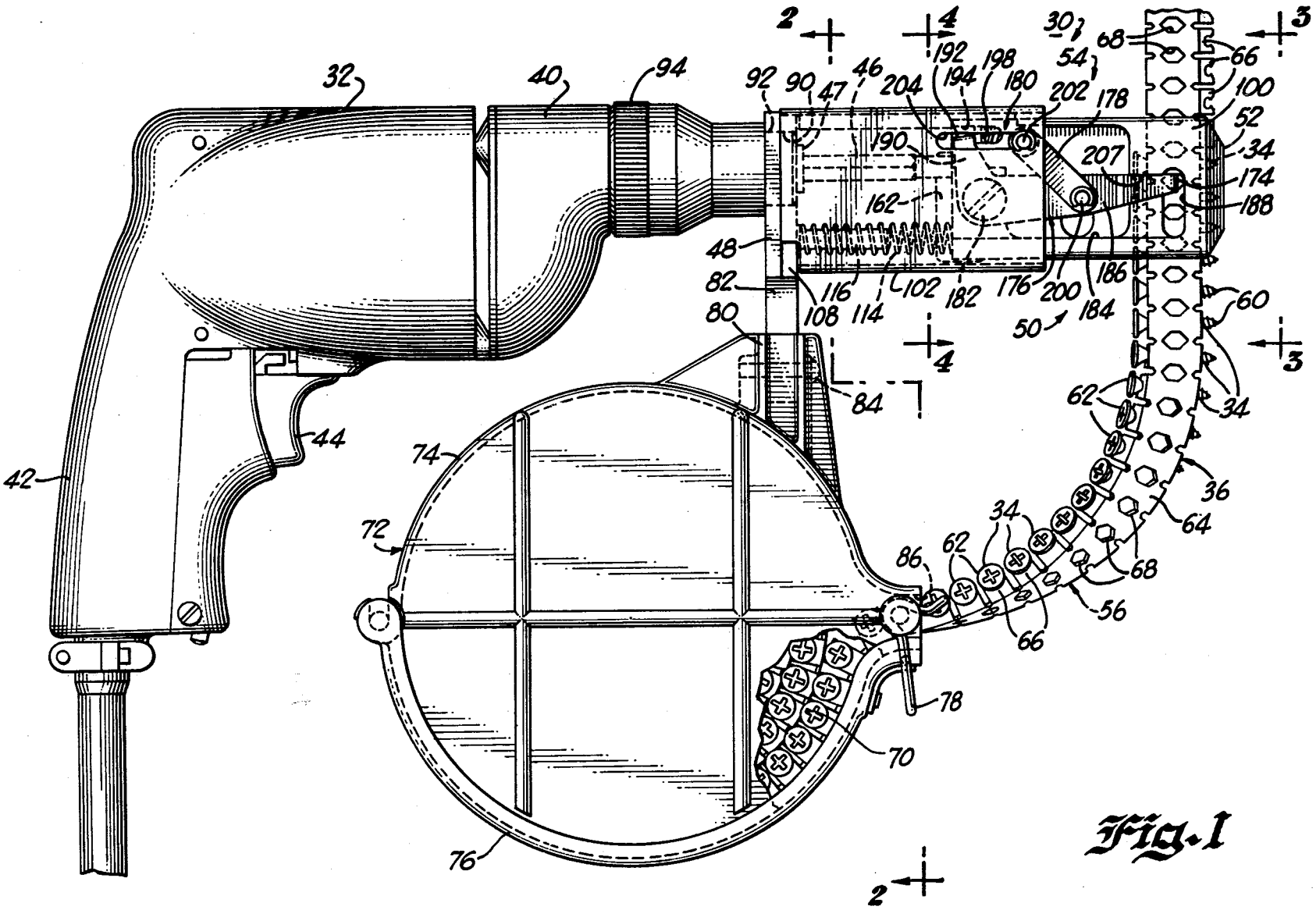
FIG. 1 is a side elevational view of a fastener feed assembly constructed in accordance with the present invention and illustrated in conjunction with a power screwdriver.

With reference now to the drawings, and initially to the embodiment of the invention illustrated in FIGS. 1–18 there is shown a fastener feed assembly designed as a whole by the reference numeral 30 and constructed in accordance with the principles of the present invention. The assembly 30 is mounted on a fastener driving tool 32, and in the illustrated embodiments of the invention, the tool 32 is a power screwdriver. The fastener feed assembly 30 of the present invention serves to feed individual fasteners 34 from a fastener strip 36 into driving position relative to the tool 32 whereupon the fasteners are driven by the tool 32 into a workpiece, such as the workpiece 38 illustrated in FIGS. 14–18.

Principles of the present invention are applicable to the feeding of various types of threaded fasteners or rotary entry fasteners to fastener driving tools of many types. In the illustrated arrangements, the tool 32 is a power screwdriver adapted for the driving of fasterners to attach drywall panels 38A (FIGS. 14–18) to metal studs 36B. The tool includes a housing 40 with a unitary handle portion 42, and a motor (not shown) such as an electric motor or fluid motor is mounted within the housing 40. A trigger 44 adjacent the handle 42 controls the energization of the motor.

Figures 5, 6, 7:
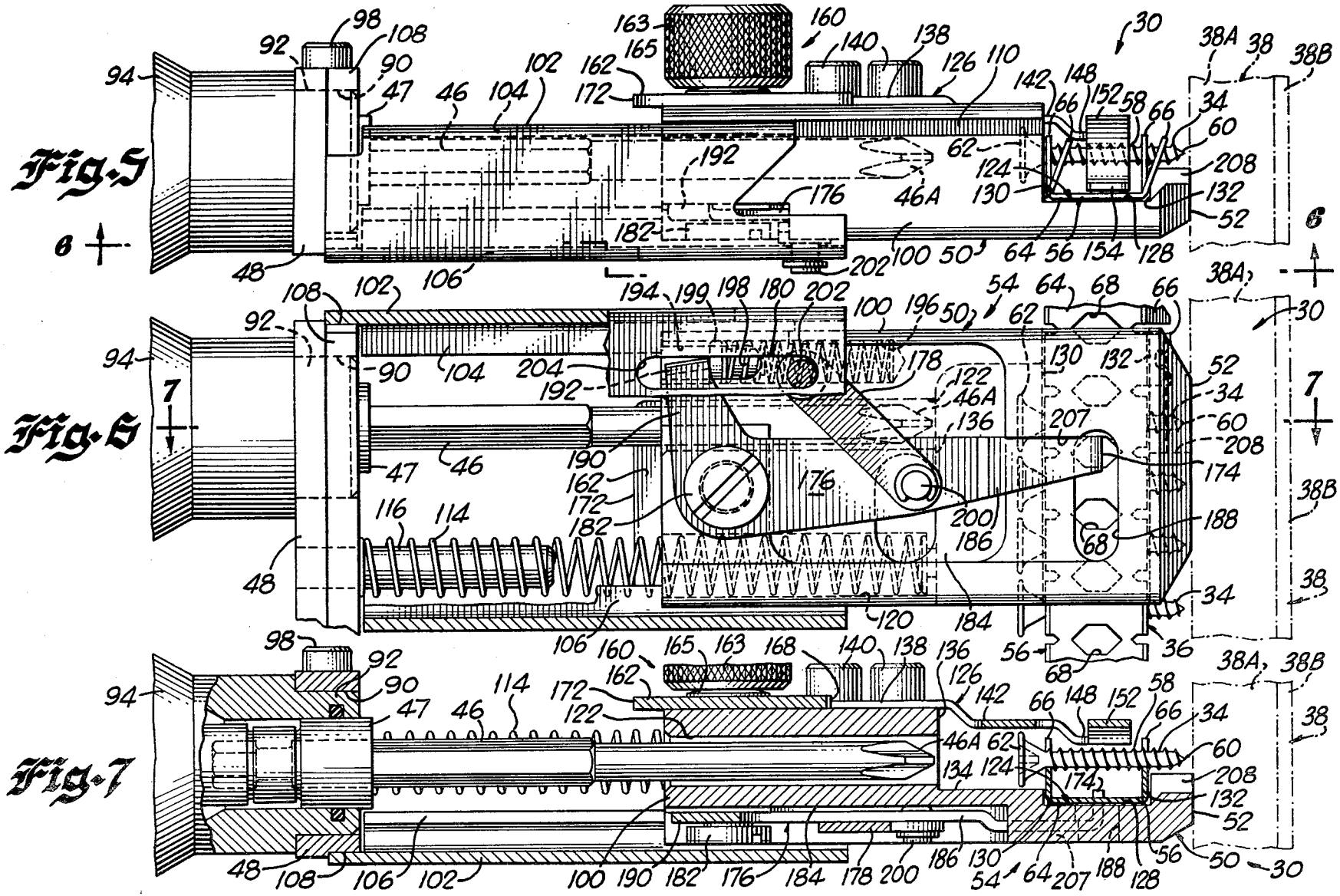
FIG. 5 is an enlarged top plan view of the assembly of FIG. 1.
FIG. 6 is a side view, partly in section, taken along the line 6—6 of FIG. 5.
FIG. 7 is a sectional view taken along the line 7—7 of FIG. 6.

A rotary driving member or bit 46 extends from the housing 40 and includes a tip portion 46A engageable with fasteners 34 for driving the fasteners. Since the tool 32 is intended for the mounting of drywall panels, the tool may be provided with a conventional depth sensitive clutch assembly 47 (FIG. 7). Clutch assembly 47 functions to couple the bit 46 to the tool motor for rotation of the bit in response to pushing of the bit against a fastener. Moreover, the clutch assembly 47 uncouples the bit from the motor when the fastener is driven to a desired depth. One example of a tool of this character provided with a depth sensitive clutch is the Model 2035 screwdriver manufactured and sold by the Black & Decker Manufacturing Company, Towson, Md. 21204, illustrated in its catalog No. PE-3 (7/73 Supplement) BP.

In the use of a tool for driving threaded fasteners, the tool drive member or bit is engaged with a fastener to be driven, and then is pressed against the workpiece while the bit rotates the fastener in order to drive the fastener into the workpiece. In accordance with an important feature of the present invention, the relative movement of the tool with respect to the workpiece is utilized to feed successive fasteners 34 from the strip 36 into drive position in alignment with the bit 46.

In general, the fastener feed assembly 30 includes a base member 48 adapted to be mounted to the tool 32 thereby to support the assembly 30 in position on the tool. The assembly also includes a nose assembly 50 having a workpiece engaging surface 52 pressed against the workpiece 38 during the fastener driving operation. The base 48 and nose assembly 50 are movable relative to one another as the tool 32 is moved toward and then withdrawn from the workpiece. In accordance with the invention, there is provided a feed mechanism designated as a whole by the reference numeral 54 and operated in response to relative movement of the nose assembly 50 and base member 48 for incrementally advancing the fastener strip 36 in order to locate individual fasteners in sequence for driving by the tool 32.

In the illustrated arrangement, each fastener 34 includes a shank portion 58, at least a portion of which is threaded, a tip 60 at the entry end of the shank 58, and a head 62 at the opposite end of the shank. The head 62 is provided with a drive slot structure complimentary with the tip 46A of the bit 46 in accordance with known practice. Rotary entry fasteners or threaded fasteners are provided in many forms, and the present invention can be used with advantage in feeding many types.

With reference now to the fastener stip 36, in the illustrated embodiments of the invention the strip 36 is of the type disclosed in U.S. Pat. No. 3,438,487, to which reference may be had for details of its structure. The strip 36 includes a carrier member 56 in the form of an elongated strip of flexible plastic material having a generally channel-shaped cross section. A base or web portion 64 is continuous throughout the length of the strip 36 and tabs 66 extend from the opposite sides of the base 64 in opposed pairs. Each tab 66 is provided with a fastener holding slot structure and opposed pairs of the tabs 66 frictionally retain a fastener with its shank portion 58 parallel to the plane of the adjacent carrier base portion 64 and with its major longitudinal axis generally perpendicular to the adjacent segment of the fastener strip 36. The base portion 64 is provided with a series of openings 68, each being offset longitudinally on the strip from the shank portion 58 of an adjacent fastener 34. The fasteners 34 can be collated on the carrier 56 using any suitable means such as, for example, the collating machine shown in U.S. Pat. No. 3,538,673. The strip 36 can be formed in a running length, or in a coil as shown in U.S. Pat. No. 3,450,255.

In accordance with the present invention, the fastener strip 36 is formed in a coil 70 and is supplied to the nose assembly 50 from a magazine 72 disposed conveniently with respect to the tool 32 and feed assembly 30. The fastener strip 36 is twisted through a substantial angle, ninety degrees in the illustrated embodiment, in that portion of the strip extending between the magazine 72 and the nose assembly 50 of the feed assembly 30. As illustrated in FIG. 1, the feed assembly 30 is generally in line with the housing 40 of the tool 32 and the handle 42 is angularly related to the common principal axis of the housing and feed assembly. In accordance with the invention, the magazine 72 is supported within the angle included by the handle 42 and housing 40 and moreover lies generally in the same plane as the plane defined by the housing 40 and handle 42. As a result, the magazine 72 does not protrude in an awkward manner to the sides of the tool 32, and the weight of the magazine 72 and coil 70 is suspended directly beneath the major axis of the tool 32 and assembly 30 so that there is no tendency for the tool to twist in the hand of the operator. Twisting of the strip prevents interference between the strip and the workpiece, and permits the strip to flex as the tool and magazine are moved relative to the nose assembly.

Referring more specifically to the structure of the magazine 72, the magazine comprises a housing 74 preferably formed of a relatively lightweight yet strong material, such as a suitable plastic or the like. The housing 74 is generally circular in outline so as to enclose the coil 70 of the fastener strip 36. A generally semicircular portion of the peripheral wall of housing 74 comprises a hinged door 76 releasably latched in the illustrated closed position by a latch assembly 78. A socket 80 is formed on the housing 74 in order to mount the magazine 72 on a downwardly projecting leg 82 of the base member 48 of the feed assembly 30, as by means of a screw fastener 84. When the coil 70 of the fastener strip 36 is initially mounted in the magazine 72, the outer, leading end of the strip is fed out of the magazine through a feed opening 86 defined in the housing 74. The lead end of the strip 36 is twisted through ninety degrees and is fed into the nose assembly 50.

Proceeding to a more detailed description of the structure of the fastener feed assembly 30, the base member 48 is in the form of a block-like body including a circular opening 90 for attaching the base 48 to a projecting boss 92 of an adapter member or clutch housing 94 carried by the housing 40 of the tool 32. A slot 96 (FIGS. 2 and 12) extends between the opening 90 and the exterior edge of the base 48, and a screw member 98 is tightened in order firmly to hold the base 48 in position on the member 94. The magazine support leg 82 preferably is an integral part of the base member 48 and the magazine 72 as well as the base member 48 are held in a fixed position relative to the tool housing 40.

The major structural component of the nose assembly 50 is a nose block 100. The block 100 is mounted for reciprocal movement relative to the base member 48 by means of a slide member 102. In section (see, for example, FIGS. 2–4 and 13) the slide member 102 is somewhat J-shaped or C-shaped, and terminates in a pair of inwardly directed slide flanges 104 and 106. One end of the slide member 102 is secured to the base member 48. More specifically, the base member 48 includes a recessed mounting surface 108 on two adjacent edge walls thereof for receiving the end of the slide member 102, and the slide member 102 is suitably fastened in any desired manner as by welding in place.

In order to support the nose block 100 on the slide member 102, the block 100 is provided with a pair of slide slots 110 and 112 extending throughout the length of the block into which the slide flanges 104 and 106 respectively are received. When the block 100 is slidingly positioned in the slide member 102, the block is free to move toward and away from the base member 48 and is constrained against movement in other directions. Due to its partly rectangular, generally J- or C-shape, the slide member covers and protects the nose assembly 50.

A return spring 114 (FIGS. 1, 6 and 12) is held in compression between the base member 48 and the nose block 100 in order to urge the nose block 100 toward its outermost position (FIGS. 1 and 6). A spring retaining pin 116 is mounted on the base member 48 and extends toward the nose block 100. The spring 114 and pin 116 are slidably received in an aligned opening 120 in the block 100 of sufficient length to permit reciprocal movement of the block 100 relative to the base member 48.

The drive member or bit 46 in accordance with conventional practice is located generally in line with the major axis of the tool housing 40. The bit is concentric with and extends from the adapter member or clutch housing 94 fixed to the housing 40, and thus extends through the opening 90 of the base member 48 toward the block 100 of the nose assembly 50. The block 100 is provided with an opening or drive channel 122 receiving the bit 46 and permitting both longitudinal and rotational movement of the bit with respect to the block 100.

In order to permit feeding of the fastener strip 36 through the nose assembly 50 for registration of the fasteners 34 in sequence with the bit 46, a feed path 124 is defined by the nose assembly 50 and more specifically by the nose block 100 and by a guide member 126 mounted on the block 100. As best appears in FIGS. 5 and 7, the feed path 124 comprises a recess or opening extending through the block 100 in a direction transverse to the direction of movement of the block. The path 124 is defined in part by a base wall 128 flanked by a pair of side walls 130 and 132, these walls being shaped to slidingly receive the base portion 64 and the tabs 66 of the strip carrier member 56. In addition, the path 124 is further defined by a pair of walls 134 and 136 (FIGS. 10 and 12) permitting movement of the head portions 62 of fasteners 34 into the nose assembly 50. Although in the illustrated arrangement the wall 136 is spaced substantially from the fastener heads 62, it will be understood that if fasteners of greater length are used, the portion of the feed path 124 defined by walls 134 and 136 permits movement of the fasteners into the nose assembly 50. The workpiece engaging surface 52 of the nose assembly 50 is defined on the block 100, and specifically on the outermost portion of the block opposite the wall 132. Preferably the fasteners 34 are mounted in the carrier 56 in such a way that prior to the drive operation the tips 60 are located adjacent to but do not extend beyond the workpiece engaging surface 52.

Guide member 126 cooperates with block 100 in defining the feed path 124 and functions to guide the fastener strip 36 into the feed path and to retain the strip in the path. The guide member 126 includes a foot portion 138 fastened to the block 100 in any suitable manner as by a pair of cap screws 140. A guard portion 142 of the guide member 126 extends over the feed path 124 and serves to cover the region through which the bit 46 moves during a fastener driving operation. A guard flange 144 extends toward the wall 134 (FIG. 10) and encloses the head 62 of a fastener 34 in the drive position.

Opposite the foot portion 138, the guide member 126 includes a sloping entry guide flange 146 leading to an elongated guide surface 148 opposed to the wall 128 of the block 100. As can best be seen in FIGS. 3 and 9, the fastener strip 36 is guided into the feed path 124 by the flange 146. The guide surface portion 148 enters between the opposed rows of tabs 66 of the carrier 56 in order to cooperate in holding the carrier in position. Movement of the carrier 56 away from the wall 128 is prevented by engagement of the guide surface 148 with the shank portions 58 of the fasteners 34.

Upon insertion of the fastener strip 36 into the feed path 124, a first fastener 34 of the strip is located in a drive position in line with the bit 46 in the nose assembly 50. A generally rounded segment 152 of the terminal portion of the guide member 126 surrounds the drive position and provides room for movement of the head 62 of a fastener from the block 100 and into the workpiece 38. Opposite the entry guide flange 146, the guide member 126 also includes an exit guide member 154 for guiding the carrier strip 36 out of the feed path 124. The exit guide member 154 is of particular importance in maintaining the strip in position as the last few fasteners of the strip are driven.

Once the fastener strip 36 has been initially loaded into the feed path 124 with a fastener 34 located in the drive position 150, a fastener driving operation can be carried out. The nose assembly 50 is placed against the workpiece 38 with the workpiece engaging surface 52 abutting the workpiece. The tool 32 is then pressed toward the workpiece to advance the bit 46 through the opening 122 in the nose block 100. Movement of the tool toward the workpiece continues until the tip 46A engages the head 62 of the fasteners 34. The fastener is forced by the bit against the surface of the workpiece.

If a depth sensitive clutch is provided for the tool 32, the force resulting from pushing the bit and fastener against the workpiece causes the clutch to become engaged so that the motor of the tool 32 is coupled to the bit 46 in order to rotate the bit. The tool 32 is pushed further toward the workpiece and as a result the fastener is driven into the workpiece. When the fastener is fully driven as illustrated in FIG. 16, further movement of the tool toward the workpiece is prevented. The reduction in axial force applied to the bit 46 causes the depth sensitive clutch to become disengaged, and thereafter the tool 32 is withdrawn away from the workpiece.

The feed assembly 30 can also be used with tools not provided with clutch mechanisms. In this case the movement of the tool relative to the workpiece is the same, and the bit may either be rotated continuously, or alternatively the rotation of the bit may be selectively controlled by other means as by manual operation of the trigger 44.

Figures 8, 9, 10, 11:
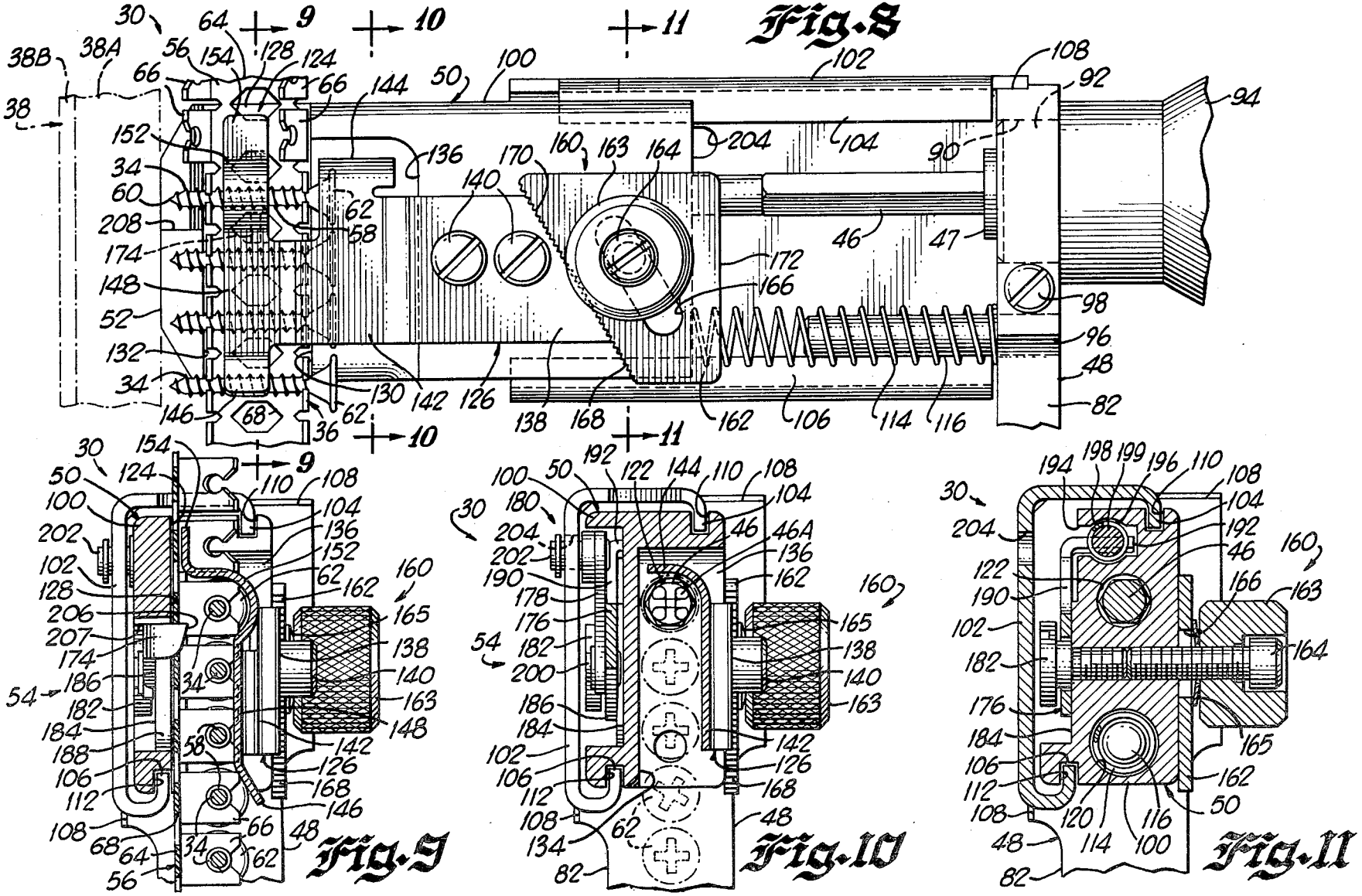
FIG. 8 is a side elevational view on an enlarged scale of the assembly of FIG. 1 and illustrating the side opposite to that shown in FIGS. 1 and 6.
FIG. 9 is a sectional view taken along the line 9—9 of FIG. 8.
FIG. 10 is a sectional view taken along the line 10—10 of FIG. 8.
FIG. 11 is a sectional view taken along the line 11—11 of FIG. 8.
Figure 12:
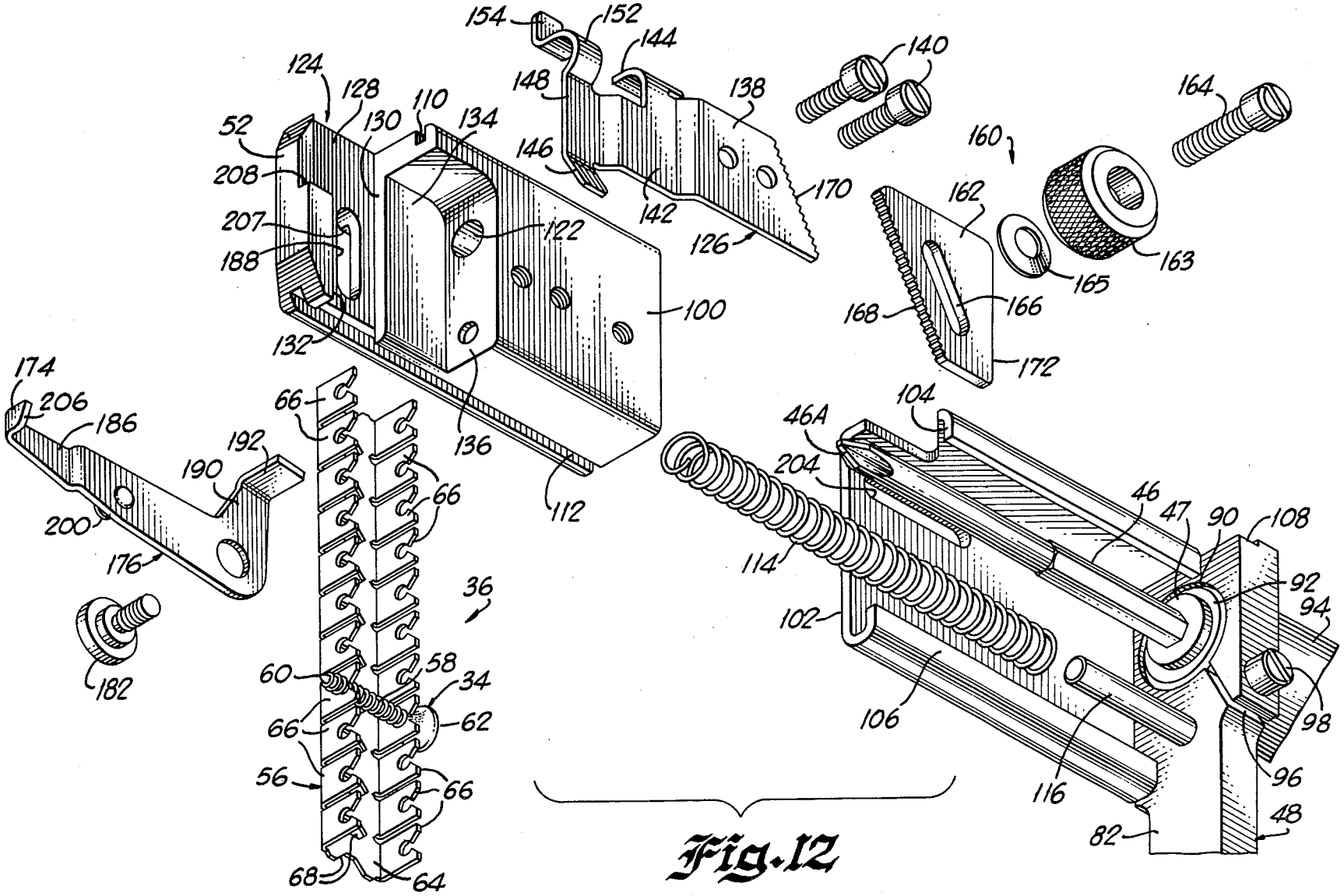
FIG. 12 is an exploded perspective view on an enlarged scale of parts of the assembly of FIG. 1.

The depth to which a fastener 34 is driven during the driving operation is determined by an adjustable depth stop assembly generally designated as 160 (FIGS. 8, 11 and 12). An adjustable stop plate 162 is held against one side of the nose block 100 by means of a releasable adjustment nut 163 carried by a screw 164 extending through an inclined slot 166 in the plate 162. A spring washer 165 resiliently maintains the plate 162 against the block 100. The plate 162 includes an inclined, serrated edge 168 adapted to interfit with a correspondingly inclined and serrated edge 170 of the base pad portion 138 of guide member 126. Opposite the serrated edge, the plate 162 includes a stop edge 172 directed toward the base member 48.

By loosening the nut 164 and positioning the plate 162, the position of the edge 172 is adjusted to limit the maximum movement of the nose assembly 50 toward the base member 48. In the illustrated position, the stop edge 172 engages the base member 48 when the bit 46 has moved sufficiently to drive the fastener 34 to a flush position into the workpiece 38. The depth stop assembly 160 may be adjusted from its illustrated position to provide for any desired countersink depth of the fasteners 34.

During the fastener driving operation, it can be seen that the base member 48 and nose assembly 50 are moved toward one another during the drive stroke and are moved away from one another by the return spring 114 during the withdrawing motion. In accordance with an important feature of the present invention, this relative movement during the fastener driving operation is used to operate the feed mechanism 54 in order to advance the fastener strip 36 in increments through the feed path 124.

In general, the feed mechanism 54 includes a feed pawl 174 associated with a pawl lever 176. A drive link 178 causes the pawl 174 to move between a home position (FIGS. 6, 9 and 14) and a cocked position (FIGS. 15 and 16) as the base member 48 is moved toward the nose assembly 50. Conversely, when the base member 48 moves away from the nose assembly 50, the pawl 174 is returned in the opposite direction to the home position in order to advance the fastener strip 36 through one increment of movement along the feed path 124. A lost motion connection generally designated as 180 is associated with the drive link 178 in accordance with the invention in order to insure that operation of the feed mechanism 54 does not interfere with the driving of a fastener 34 by the bit 46.

A shoulder screw 182 (FIGS. 11 and 14–18) pivotally supports the pawl lever 176 on the nose block 100. The lever 176 and screw 182 are located in a recess 184 in the side wall of block 100 to achieve a compact configuration and to make it possible to locate the feed mechanism 54 in a protected position under the wall of the slide member 102.

The pawl lever 176 includes a leg 186 extending from the pivot screw 182 toward the feed path 124. The terminal end of the leg 186 is bent in a transverse direction to form the pawl 174. A slot 188 is provided in the block 100 and extends to the wall 128 in order to permit engagement of the pawl with the base portion 64 of the carrier 56.

In order to bias the pawl 174 to the home position illustrated in FIG. 6, the lever includes a second leg 190 terminating in transverse a spring retainer portion 192. The portion 192 extends through a slot 194 and into a spring cavity 196 formed in the nose block 100. A pawl return spring 198 carries a pusher element 199 and is held in compression against the portion 192 in order continuously to bias the lever 176 in a counterclockwise direction as viewed in FIGS. 14–16.

One end of the drive link 178 is pivotally connected to a point along the length of the leg 186 of the pawl lever 176 by a pivot pin 200. The opposite end of the link 178 is pivotally and slidably interconnected by a pivot pin 202 with a slot 204 formed in the slide member 102. Consequently, when the base member 48 and thus the slide member 102 move toward the nosepiece assembly 50 from the position illustrated in FIG. 14 to the position illustrated in FIG. 15, the pawl lever 176 is rotated against the force applied by the spring 198 to move the pawl from its home position to the cocked position illustrated in FIGS. 15 and 16.

As best seen in FIG. 9, the pawl 174 is provided with a cam surface 206 so that the pawl 174 can move toward the cocked position without driving the fastener strip 36 in the reverse direction. Substantial clearance exists beneath the head of the shoulder screw 182 (FIG. 11) to permit movement of the leg 186 away from the nose block 100. Thus, during cocking movement, the pawl 174 is retracted by the cam surface 206 out of the plane of the carrier base portion 64.

After driving of a fastener 34 when the base member 48 and slide 102 move away from the nose assembly 50, the pawl 174 moves in the opposite direction from the cocked position of FIG. 16 to the home position of FIG. 6. This movement is occassioned by the operation of the spring 198. In the cocked position, the pawl 174 may or may not be aligned with one of the openings 68 in the carrier 56 because the cocked position varies with the setting of the adjustable depth stop assembly 160. During movement from the cocked position to the home position, the pawl registers with an opening 68. As can be seen in FIG. 11, the pawl return spring 198 also biases the pawl lever 176 in a direction to urge the pawl 174 into the opening 68. During its return movement, the pawl advances the fastener strip 36 so that a next sequential fastener 34 is positioned in the drive position. In the home position, leg 186 seats against a shoulder 207 of nose block 100 (FIGS. 6 and 13).

In accordance with a feature of the invention, the lost motion connection 180 prevents cocking of the pawl until after the bit 46 engages and begins to drive a fastener 34. More specifically, during the initial portion of the driving stroke as the slide member 102 moves relative to the nose assembly 50 from the position illustrated in FIG. 6 to the position illustrated in FIG. 14, the pivot pin 202 merely slides along the slot 204. Thus, during this segment of movement, no rotation is imparted to the pawl lever 176. As the slide member 102 moves to the position illustrated in FIG. 14, the bit 46 securely engages and begins to drive the fastener 34. It is only after movement beyond the position of FIG. 14, when the pin 202 reaches the end of the slot 204, that the pawl 174 begins to move away from its home position. At this point, operation of the feed mechanism does not interfere with driving of the fastener.

Also in accordance with a feature of the invention, the pawl 174 is not retracted from its cocked position to the home position until after the bit 46 has been moved substantially clear of the carrier 56 in the feed path 124. More specifically, as illustrated in FIGS. 15 and 16, when the pawl 174 has been moved to its cocked position, the link 178 is in an overcenter or locked position. In this position, the link 178 forms an angle of nearly 90° or more with the leg 186 and the spring 198 is unable to pivot the pawl lever 176 in a counterclockwise direction as illustrated in FIG. 15. Thus, during the first portion of movement of the base member 48 and slide 102 away from the nose assembly 50 — i.e. movement from the position of FIG. 15 to the position of FIG. 16 — the pivot pin 202 simply moves in the slot 204. As the bit 46 moves clear of the carrier 56, the pin 202 reaches the end of the slot 204 and the link 178 is moved back overcenter thus unlocking the lever 176 and permitting the spring 198 to pivot the lever.

One advantage of the feed mechanism 54 of the present invention is that no frictional retaining device, return pawl, or the like is required to prevent reverse movement of the fastener strip 36 during cocking movement of the pawl. In part, this advantage arises from the fact that the pawl lever 176 is mounted somewhat loosely by shoulder screw 182 and biased relatively lightly toward carrier strip 56 by spring 198. This arrangement permits the pawl 174 readily to ride out of the openings 68 and over the surface of the base portion 64 of the carrier 56. In addition, in accordance with a feature of the present invention, a part of the fastener strip 36 is itself deformed during the drive operation in order to provide a stop against reverse movement.

More specifically, as can be seen in FIG. 17, as a fastener 34 is driven into the workpiece by the bit 46, the tabs 66 are bent to an angular position relative to the base portion 64. The nose block 100 is stepped along the workpiece engaging surface 52 to provide a stop shoulder 208 shown in FIGS. 3 and 17. This shoulder is disposed adjacent the edge of one of the tabs 66 supporting a fastener 34 in the drive position. When this tab is deformed, it overlies the stop surface 208 and effectively prevents movement of the fastener strip in the reverse direction through the feed path 124.

While the invention has been described with reference to details of the illustrated embodiments, it should be understood that such details are not intended to limit the invention as defined in the following claims.

What is claimed and desired to be secured by Letters Patent of the United States is:

1. A method of controlling the movement of a strip of fasteners in increments to locate individual fasteners of the strip sequentially at a drive position, said method comprising:
   - periodically advancing the strip a distance equal to the space between fasteners;
   - deforming the strip after each said advancing step to provide a deformed portion of the strip; and
   - moving the deformed portion of the strip into engagement with a stop to prevent reverse movement.

2. A method of controlling the movement of a strip of fasteners in increments to locate individual fasteners of the strip sequentially at a drive position, said method comprising:
   - periodically advancing the strip a distance equal to the space between fasteners; and
   - deforming the strip after each said advancing step into engagement with a stop to prevent reverse movement; said deforming step being carried out by engaging the strip with a fastener drive member during driving of a fastener from the drive position.

3. A method of controlling the movement of a strip of fasteners of the type including a carrier having fastener-supporting tabs, said method comprising the steps of:
   - periodically advancing the strip a predetermined distance to locate a fastener in a predetermined position; and
   - bending one said tab into alignment with a stop to prevent reverse movement of the carrier.

4. The method of claim 3, said bending step comprising bending that tab which supports said fastener at said predetermined position.

5. The method of claim 4, wherein the method comprises bending said tab by removing said fastener from said tab.

6. The method of claim 5 wherein said removing is accomplished in a fastener driving operation.

* * * * *